United States Patent [19]

Rummel

[11] Patent Number: 4,663,948

[45] Date of Patent: May 12, 1987

[54] CONTROL CIRCUIT FOR COMBINATION WASHER AND DRYER

[75] Inventor: Raymond W. Rummel, Webster City, Iowa

[73] Assignee: White Consolidated Industries, Inc., Cleveland, Ohio

[21] Appl. No.: 659,846

[22] Filed: Oct. 11, 1984

[51] Int. Cl.[4] ..... D06F 33/02

[52] U.S. Cl. ..... 68/12 R; 68/20; 307/38

[58] Field of Search ..... 68/12 R, 20; 307/38, 307/39, 35

[56] References Cited

U.S. PATENT DOCUMENTS

| | | | |
|---|---|---|---|
| 1,194,165 | 8/1916 | Fry | 307/35 X |
| 1,503,130 | 7/1924 | Moore | 307/35 |
| 1,894,119 | 1/1933 | Pratt | 307/35 |
| 2,521,171 | 9/1950 | Kercher . | |
| 3,824,813 | 7/1974 | Davis | 68/12 R |
| 4,472,640 | 9/1984 | Elmer | 307/38 X |

FOREIGN PATENT DOCUMENTS

| | | | |
|---|---|---|---|
| 2735807 | 2/1979 | Fed. Rep. of Germany | 68/12 R |
| 59-85689 | 5/1984 | Japan | 68/12 R |
| 1598923 | 9/1981 | United Kingdom | 68/12 R |

*Primary Examiner*—Harvey C. Hornsby
*Assistant Examiner*—Frankie L. Stinson
*Attorney, Agent, or Firm*—Pearne, Gordon, McCoy & Granger

[57] ABSTRACT

A combination clothes washer and dryer of the domestic type, powered by a 110 volt, 15 or 20 ampere residential power line, includes a motor driven washer, and a motor driven tumbler type dryer supplied with heated air by an electrical resistance heater. When simultaneous operation of the washer motor and dryer motor occurs, power supplied to the electrical resistance heater is automatically reduced by half so as to allow the washer motor, dryer motor, and resistance heater to continue operating without exceeding the power providing capabilities of the residential power line. Such power reduction is provided by a half-wave rectifier in the form of a diode switched into series circuit relationship with the resistance heater when the washer motor is operating.

4 Claims, 2 Drawing Figures

CONTROL CIRCUIT FOR COMBINATION WASHER AND DRYER

BACKGROUND OF THE INVENTION

The present invention relates in general to electrical control circuitry, and more specifically to the control circuitry of a combination washer and dryer of the domestic type adapted to operate from a 120 volt, 15 or 20 ampere residential power line.

U.S. Pat. No. 3,824,813, owned by the assignee of the present invention and incorporated herein in its entirety by reference, is directed to the control circuitry of a combination washer and dryer which includes a motor driven clothes washer, a motor driven tumbler type clothes dryer, and an electrical resistance heater for supplying heated air to the clothes tumbling drum of the dryer. This prior art control circuit includes a lockout relay which disconnects the electrical resistance heater from the power line when the motor drive of the washer is operating.

Such a feature precludes the simultaneous operation of the washer motor, dryer motor, and resistance heater which, if operated together at their full electrical power levels, would exceed the power providing capability of the 120 volt, 15 or 20 ampere residential power line. Thus, when both the washer and dryer motors are operating, only non-heated ambient or room air is provided to the dryer drum. While clothes tumbling in the dryer drum will eventually dry, the time for such room air drying can be excessive.

It is a goal of the present invention to provide means for accomplishing, relative to the aforementioned prior art, accelerated drying of clothes when both the washer and dryer motors are operating.

It is a further goal of the present invention to provide such drying in a simple, reliable, and inexpensive manner.

SUMMARY OF THE INVENTION

A combination clothes washer and dryer of the domestic type includes a washer driven by a first electrically energized motor means, and a tumbler type dryer driven by a second electrically energized motor means. An electrical resistance heater provides heated air to the dryer.

In accordance with the present invention, means are provided to automatically reduce the electrical power consumed by the resistance heater when simultaneous energization of the first and second motor means occurs. Thus, the resistance heater is energized at a reduced power level at least until the first motor means is de-energized, thereby permitting the combination washer and dryer to operate from an electrical power source incapable of simultaneously energizing, at a maximum power level, the first and second motor means and the resistance heater.

Preferably, the combination washer and dryer operates from a 120 volt, 15 or 20 ampere residential power line, the power reducing means being constituted by a semiconductor diode that is automatically connected in series circuit relationship with the resistance heater whenever the first motor means, i.e. the washer motor, is operating.

Such a feature allows the resistance heater to operate at a reduced power level of approximately 50% when both motor means for the washer and dryer drum are energized. Such operation of the combination washer and dryer provides accelerated drying of clothes in the dryer as opposed to the aforementioned prior art where the electrical resistance heater was completely de-energized until the motor means driving the washer was de-energized.

BRIEF DESCRIPTION OF THE DRAWINGS

A fuller understanding of the invention may be had by referring to the following description and claims taken in conjunction with the accompanying drawing wherein:

DETAILED DESCRIPTION OF THE PREFERRED EMBODIMENT

Figure 1:
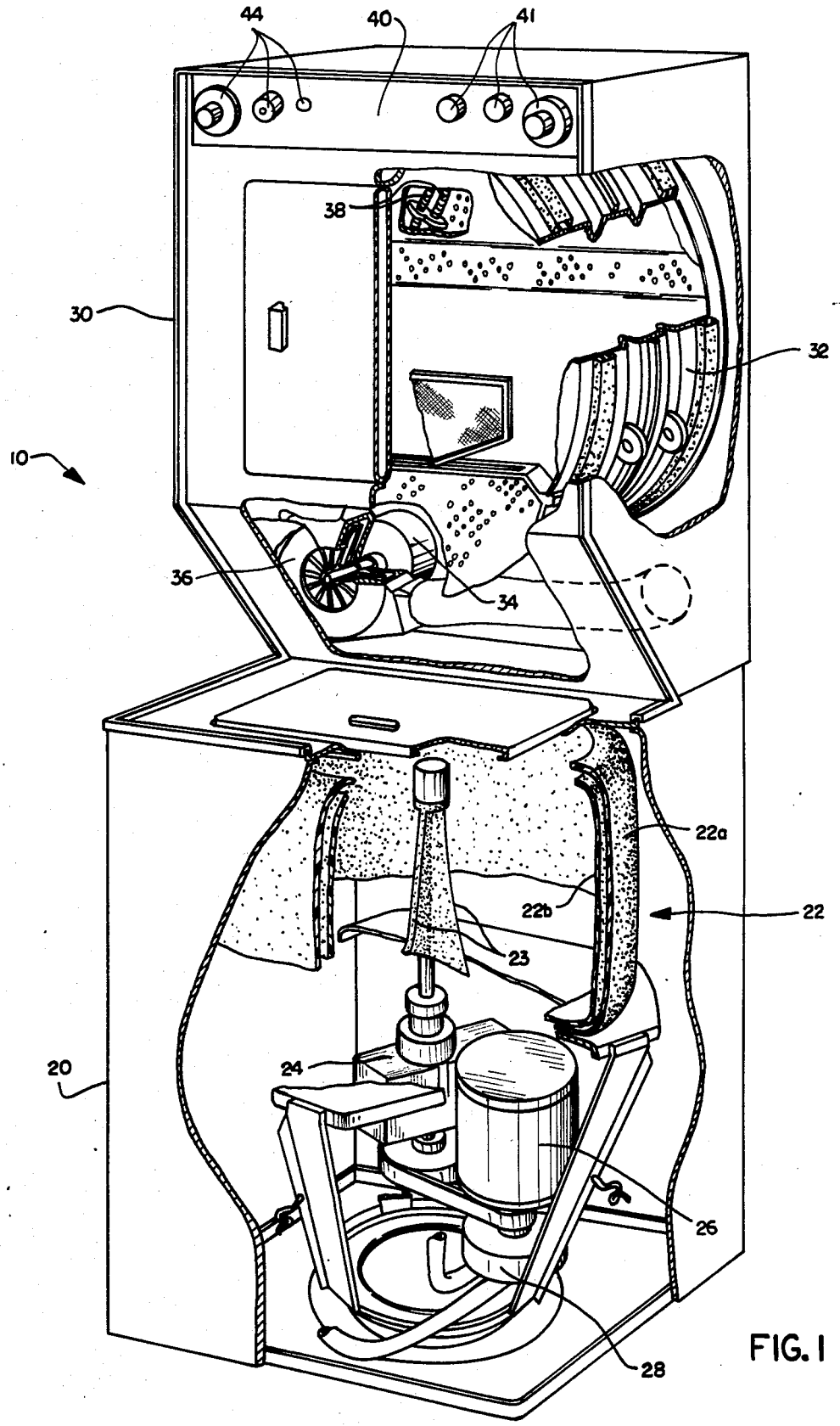
FIG. 1 is a perspective view of a combination washer and dryer of the domestic type with portions cut away.

FIG. 1 illustrates a combination clothes washer and dryer 10 of the domestic type which incorporates a control circuit in accordance with the present invention as will be subsequently illustrated in greater detail with reference to FIG. 2. The combination washer and dryer 10 includes, as a lower or base part thereof, a clothes washer 20 of the top loading type as illustrated. Mounted upon, and supported above and by the clothes washer 20, is an associated clothes dryer 30 of the tumbler type which is front loading as illustrated.

The clothes washer 20 includes a clothes washing tub 22 having a fixed outer tub **22*a* and a rotatable inner tub 22*b*. The clothes washing tub 22 contains a movable agitator 23, the inner tub 22*b* and the agitator 23 being driven by a transmission 24 which in turn is driven by a first electrically energized motor means 26 of for example a fractional horsepower, conventional induction type. The motor means 26 also drives a water pump 28 for supplying water to or extracting water from the wash tub 22. As is well known in the art, clothes placed into the tub 22 are cycled through a plurality of clothes washing operations. As a final operation, the clothes within the tub 22 are spun by high speed rotation of the inner tub 22*b* to extract most of the water therefrom, and then removed and put into the clothes dryer 30**.

The clothes dryer 30 includes a rotatably supported tumbler type clothes drying drum 32 which is driven by a second electrically energized motor means 34, also of the fractional horsepower, conventional induction type. The motor means 34, in addition to rotating the drum 32, drives a centrifugal type blower 36 which causes air to flow through the clothes drying drum 32. Drying air flowing into the clothes drying drum 32 can be heated by first passing it over an electrical resistance heater 38 so as to maximize the amount of moisture that can be drawn from the clothes tumbling in the drum 32 over a period of time.

A control panel 40 is mounted across the top front portion of the clothes dryer 30 as illustrated, the control panel 40 providing a plurality of user actuated washer controls 41 and a plurality of associated dryer controls 44.

Figure 2:
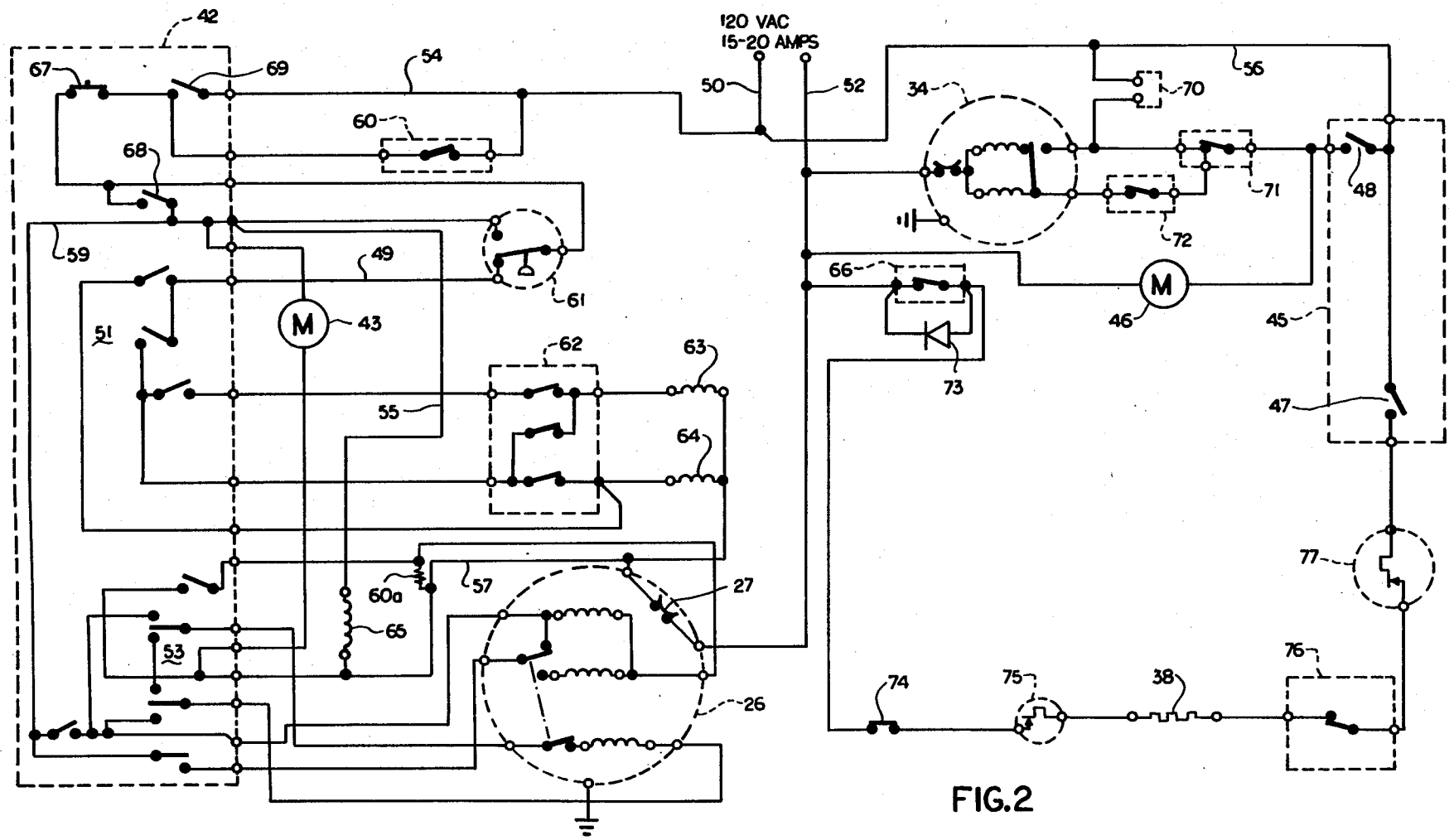
FIG. 2 is a schematic diagram of a control circuit in accordance with the present invention for use in energizing and controlling electrical elements of the combination washer and dryer illustrated in FIG. 1.

The elements illustrated and discussed with regard to FIG. 1 are well known in the art, the present invention being illustrated by FIG. 2 which is a schematic diagram of the control circuitry for the combination washer and dryer of the type illustrated in FIG. 1.

The control circuitry of FIG. 2 is energized by a 120 volt alternating current residential power source which can provide 15 or 20 amperes of current. The source is connected by conventional means, e.g. a plug, to a voltage providing power line or hot line 50 and an associated neutral power line 52. The hot line 50 provides power to a washer circuit voltage line 54, the washer circuit being located to the left of line 52 as illustrated. In a similar fashion, the hot line 50 is also connected to provide power to a dryer circuit voltage line 56, the dryer circuit being located to the right of line 52 as illustrated.

With reference to the washer circuit, this circuit includes a first motor means, i.e. the motor means 26 of FIG. 1, which includes a plurality of motor windings (to provide forward and reverse rotation of the motor means 26) and associated motor operated switches, including a normally closed thermal overload switch 27, as illustrated. The washer control circuit also includes a water level sensing switch 61 which regulates the level of water in the wash tub of the washing machine as discussed earlier. The washer circuit further includes a water temperature selection switch 62 which regulates the energization of an associated hot water fill valve solenoid 63 and cold water fill valve solenoid 64. A conventional washer lid activated lid lock switch 60, associated with a bimetal heating element 60*a* for activating a lid locking means forming a portion of switch 60, precludes operation of the washer in a spin dry mode when the lid of the washer is in a raised or open position. A more detailed illustration of the structure and operation of the lid lock switch 60 is disclosed in U.S. Pat. No. 4,074,545, owned by the assignee of the present invention. Cycling of the washing machine through its various washing modes is accomplished by means of a timer mechanism 42 which includes a plurality of switches activated by a conventional drum type cam (not illustrated) driven in turn by a timer motor 43.

As is well known in the art, power on line 54 is provided to one side of a manually operated, push-pull, on-off switch 67 via the lid lock switch 60 or a lid switch bypass set of single pole, single throw contacts 69 provided by the timer mechanism 42 as illustrated. The bypass contacts 69 allow operation of the washer to continue when the lid is raised (switch 60 opens) during a washing mode, as opposed to a spin dry mode when the lid is manually locked in its closed position. If the washing machine is in a spin dry mode, contacts 69 are held by the timer mechanism 42 in an open position so that raising of the lid (when the locking action of switch 60 has failed) will, nevertheless, open switch 60 thereby terminating the power being applied to the on-off switch 67. Normally, lid switch 60 is in a closed condition when the washer is operating in any mode so as to provide operating voltage, via switch 67, to a timer motor switch 68 and the water level switch 61 as illustrated.

As is apparent to those skilled in the art, when either switch 68 is in a closed condition or switch 61 is in a position opposite to that illustrated, i.e. in a position indicating a full water level attainment, power is provided from line 54 to a washer motor power line 59 which provides voltage to a plurality of motor control switches 53 which can turn the motor 26 on and off in either its forward or reversed direction in accordance with the programming provided by the timer mechanism 42. On the other hand, when switch 68 is open and switch 61 is in the position illustrated in FIG. 2, power from line 54 is provided only to a fill valve power supply line 49 which in turn provides power to a plurality of water flow control switches 51 (connected to temperature control switch 62) forming a portion of the timer mechanism 42 as illustrated. It can also be seen that the timer motor 43 will operate when either switch 68 is closed or switch 61 is in the opposite position illustrated in FIG. 1. The timer motor 43 does not operate when switch 68 is open as illustrated and switch 61 is providing power to the fill valve power supply line 49 during a tub filling operation when either or both of solenoids 63, 64 are actuated. When an associated wash tub (e.g. tub 22 of FIG. 1) is filled with water to a predetermined level, switch 61 will automatically switch to its other position to terminate actuation of either or both of the solenoid valves 63, 64 and to provide power to the motor means 26 and the timer motor 43 thereby initiating a clothes washing operation. The inter-related operations of the elements as thus far described with reference to the washer circuit are well known in the art and will not be discussed in further detail.

With reference to the right side of FIG. 2, i.e. the dryer circuit portion of the combination washer and dryer control circuit, such dryer circuit includes the dryer motor means 34 of a conventional type having multiple motor windings, an internal centrifugally operated control switch and a thermal overload protector switch. The dryer circuit further includes a conventional signal ling buzzer 70, a door activated switch 71 and a push button type start switch 72. The dryer circuit also includes a dryer timer mechanism 45 including a dryer motor energizing switch 48 and a dryer heater element control switch 47. The timer mechanism 45 is of the cam drum type and is driven by a dryer timer motor 46 which is energized whenever timer switch 48 is in a closed condition.

The dryer circuit further includes a clothes drying temperature control switch 77, that cycles on and off to regulate the temperatures with the clothes tumbling drum of the dryer, a fabric selector switch 76, the electrical resistance heating element or heater 38 (as illustrated and discussed earlier with regard to FIG. 1), a high temperature limit thermostat 75 and a dryer motor operated speed sensing switch 74. The conventional elements 74, 75, 38, 76, and 77 are connected in electrical series relationship relative to each other so that each of the elements 74, 75, 76, 77 affects the operation of the heater 38. As is well known in the art, the dryer motor speed sensing switch 74 precludes operation of the heating element 38 when the dryer motor means 34 is not rotating. In a similar fashion, high temperature limit thermostat 75 opens to preclude operation of the heating element 38 when an over temperature condition is sensed in the dryer. Element 74 and 75 thus operate as conventional safety devices well known in the art. Fabric selector switch 76 is normally in a closed position to allow heater 38 to provide heat to the dryer so as to draw moisture out of the clothes tumbling in its drum portion. However, in drying delicate, temperature sensitive fabrics the use of unheated room air for drying is desirable wherein the user, by means of the earlier discussed controls 44 (see FIG. 1), opens switch 76 to preclude operation of the resistance heating element 38.

It can be seen that one end of the series connected elements 74, 75, 38, 76 and 77 is connected to one side of the resistance heater control switch 47 as illustrated.

When switch 47 is in a closed condition, voltage on line 56 can be provided to resistance heating element 38 via thermostatic control switch 77 and fabric selector switch 76. The other end of the resistance heater 38 is connected, via elements 74 and 75, to one side of a set of normally closed, single pole, single throw, control relay contacts 66 having its other side connected to the neutral line 52 as illustrated. Contacts 66 are normally closed so that the heating element will operate when elements 74, 75, 76 and 47 are also in an electrically closed circuit condition. In accordance with the present invention, means are provided to reduce the amount of power applied to the resistance heater 38 when the washer motor means 26 is operating so that simultaneous operation of the washer motor means 26, dryer motor means 34, and resistance heater 38 can occur without exceeeding the power providing capabilities of the 120 volt alternating current 15 or 20 ampere power source.

Such power reducing means takes the preferred form of a half wave rectifier constituted by a semiconductor diode 73 connected in parallel across the normally closed control relay contacts 66 as illustrated. The relay contacts 66 are controlled by a relay coil 65 which forms a part of the washer circuit (left side of FIG. 2) discussed earlier. It can be seen that the lower end of relay coil 65 is connected to a relay ground line 57 which in turn is connected to the neutral line 52 via the normally closed over temperature protection switch 27 of the motor means 26. The other end of the relay coil 65 is connected to the washer motor power line 59 via a relay energizing line 55 as illustrated. Thus, it can be appreciated whenever line voltage is applied to line 59 relay coil 65 is energized thus opening contacts 66 wherein the diode 73 is series connected with the resistance heater 38 wherein only one-half of the alternating current supply voltage i.e. 50% thereof, is provided, in the form of pulsating direct current to the resistance heater 38 which thus operates at a reduced level of power consumption so that the combined operation of the motor means 26, 34 and the heater 38 does not exceed the power providing capability of the 120 volt, 15 or 20 ampere residential power source. When power is removed from line 59 of the washer circuit, relay coil 65 is de-energized so that the relay contacts 66 can return to their normally closed position wherein full line voltage can be applied to the resistance heater 38 permitting normal operation of the dryer for maximum drying of clothes contained therein.

Thus, it can be seen that, unlike the prior art, the dryer resistance heater 38 can operate at a reduced power level when the washer motor means 26 is operating simultaneously with the dryer motor means 34. Such a feature permits accelerated drying of clothes within the dryer as compared to the noted prior art method wherein the resistance heater 38 was completely disabled. It can also be appreciated that the simplicity of providing desired reduced level operation of the heater, and the associated low cost of conventional relay elements 65, 66 and diode 73, make the invention particularly advantageous for use in the highly competitive domestic appliance industry.

Although the preferred embodiment of this invention has been shown and described, it should be understood that various modifications and rearrangements of the parts may be resorted to without departing from the scope of the invention as disclosed and claimed herein.

What is claimed is:

1. In a combination clothes washer and dryer of the domestic type including a washer driven by a first electrically energized motor means, and a tumbler type dryer driven by a second electrically energized motor means, the dryer being provided with heated air by an electrical resistance heater, the improvement comprising:

means to automatically reduce the electrical power consumed by the resistance heater when simultaneous energization of the first and second motor means occurs, wherein the resistance heater is energized at a reduced power level at least until the first motor means is de-energized, said reduced power level permitting said combination washer and dryer to operate from an electrical power source incapable of simultaneously energizing, at a maximum power level, both said first and second motor means and said resistance heater, said power source being a residential power line of the alternating current type, the power reducing means being constituted by a half-wave rectifier inserted in series circuit relationship with the electrical resistance heater at least when the first motor means is energized.

2. The combination washer and dryer of claim 1, wherein the half-wave rectifier is in the form of a semiconductor diode.

3. In a combination washer and dryer of the domestic type adapted to operate from a residential electrical power line capable of providing approximately 120 volt alternating current of up to approximately 20 amperes, the combination washer and dryer including a washer driven by a first electrically energized motor means and a tumbler type dryer driven by a second electrically energized motor means, the dryer being provided with heated air by an electrical resistance heater, said residential power line being incapable of simultaneously energizing, at a maximum power level, both said first and second motor means and said resistance heater, the improvement comprising:

a semiconductor diode; and means for automatically connecting the diode in series circuit relationship with the resistance heater at least when the first motor means is energized, wherein the resistance heater can be energized at a reduced power level by pulsating direct current provided by the diode when the first and second motor means are simultaneously operating.

4. The combination washer and dryer of claim 3, wherein said means for automatically connecting is constituted by a relay having a relay coil energized at least when said first motor means is energized, said relay including a pair of contacts connected in electrically parallel relationship with the diode, the contacts being in a normally closed conducting condition when said relay coil is de-energized, the contacts opening to an open non-conducting condition when the relay coil is energized wherein substantially all current is provided to said resistance heater via said contacts when in their closed condition, and wherein substantially all current is provided to said resistance heater via said diode when said contacts are in their open condition.

* * * * *